US009188292B2

(12) United States Patent
Armer et al.

(10) Patent No.: US 9,188,292 B2
(45) Date of Patent: Nov. 17, 2015

(54) DIVER'S UNDERWATER LIGHT FOR SELECTING BETWEEN TWO TYPES OF LIGHT

(75) Inventors: Jarod Armer, Aromas, CA (US); Doug Foss, Pacific Grove, CA (US); Christopher McCaslin, Alameda, CA (US)

(73) Assignee: Light & Motion Industries, Marina, CA (US)

( * ) Notice: Subject to any disclaimer, the term of this patent is extended or adjusted under 35 U.S.C. 154(b) by 182 days.

(21) Appl. No.: 12/927,608

(22) Filed: Nov. 17, 2010

(65) Prior Publication Data

US 2012/0120639 A1 May 17, 2012

(51) Int. Cl.

| | |
|---|---|
| ***F21V 31/00*** | (2006.01) |
| ***F21L 4/02*** | (2006.01) |
| ***F21V 23/04*** | (2006.01) |
| *F21Y 113/00* | (2006.01) |
| *F21Y 101/02* | (2006.01) |

(52) U.S. Cl.

CPC ..... *F21L 4/025* (2013.01); *F21L 4/027* (2013.01); *F21V 23/0414* (2013.01); *F21V 31/00* (2013.01); *F21V 31/005* (2013.01); *F21Y 2101/02* (2013.01); *F21Y 2113/005* (2013.01)

(58) Field of Classification Search

CPC ... F21V 31/00; F21V 21/005; F21V 23/0414; F21Y 2101/02

USPC ..... 362/184, 231, 249.02; 200/302.1–302.3, 252, 536, 547–550, 200/60

See application file for complete search history.

(56) References Cited

U.S. PATENT DOCUMENTS

| | | | | |
|---|---|---|---|---|
| 3,792,389 | A * | 2/1974 | Murphy | 335/205 |
| 3,794,825 | A * | 2/1974 | Krupansky | 362/158 |
| 6,483,651 | B1 * | 11/2002 | Maurer | 359/819 |
| 6,808,287 | B2 * | 10/2004 | Lebens et al. | 362/184 |
| 6,909,250 | B2 * | 6/2005 | Jigamian et al. | 315/307 |
| 7,199,316 | B2 * | 4/2007 | Gorrie et al. | 200/61.45 M |
| 7,303,303 | B1 | 12/2007 | Haynes et al. | |
| 7,771,077 | B2 * | 8/2010 | Miller | 362/206 |
| 2003/0095408 | A1 * | 5/2003 | Opolka | 362/241 |
| 2005/0002186 | A1 * | 1/2005 | Krieger et al. | 362/183 |
| 2005/0036306 | A1 | 2/2005 | Hsien | |
| 2005/0281020 | A1 * | 12/2005 | Liaw et al. | 362/157 |
| 2006/0077657 | A1 * | 4/2006 | Vickers et al. | 362/205 |
| 2006/0274520 | A1 * | 12/2006 | Dalton et al. | 362/157 |
| 2007/0115387 | A1 | 5/2007 | Ho | |
| 2007/0279900 | A1 | 12/2007 | Bauer et al. | |
| 2009/0014624 | A1 | 1/2009 | Blees et al. | |
| 2009/0116231 | A1 | 5/2009 | Miller | |
| 2009/0189541 | A1 | 7/2009 | Crawford | |

* cited by examiner

*Primary Examiner* — Robert May

(74) *Attorney, Agent, or Firm* — Thomas M. Freiburger

(57) ABSTRACT

An LED underwater light, which can be hand-held or mounted on an underwater camera housing, is switchable between two light modes. A first embodiment of the dive light is a focus light, used for initial focusing with a still underwater camera. Incorporated in the focus light is a red light source to which the focus light can be switched from initially projected white light. The switch is used to switch off a series of white LEDs while switching on a series of red LEDs. In a second embodiment, the dive light is a flood/spot light, and enables a diver to quickly switch between flood and spot beams, via separate LED arrays.

14 Claims, 5 Drawing Sheets

DIVER'S UNDERWATER LIGHT FOR SELECTING BETWEEN TWO TYPES OF LIGHT

BACKGROUND OF THE INVENTION

This invention concerns underwater lighting, including for photography, and in particular a compact and powerful underwater light that is easily switched from one mode to another. In one aspect the device is a focus light or imaging light for underwater diving, used to locate photography subjects in darkness or very low light situations. The device of the invention allows focusing on a subject using a camera's auto focusing feature, then moving in on a subject without disturbing the subject. In another aspect the device is a flood light that toggles to a spot light, switching modes in the same way as the imaging light.

Focusing lights for underwater diving are well known. Used in low light situations such as night diving, the focusing light, typically mounted on an underwater camera housing, is used to locate and then focus on a subject for photography, taking advantage of the auto focus feature on a still camera.

An imaging light can also be used for taking video of underwater subjects. When used as a video light the typical arrangement is with two lights separated at some distance, both focused on the subject. When used as a focus light, the typical arrangement is mounted on the top of the photo housing where the user has quick access and the light points in the same direction of the camera. In photography applications the actual photo is taken using powerful strobes. The focus light insures the camera is properly focused prior to the actual shot when the strobes fire in concert with the camera shutter. The strobes overpower the focus light, which doesn't interfere with the shot even if left on.

A problem is that the white light of the focus light tends to cause fish or other animal subjects to react, quickly escaping before being captured in a photograph. The diver is thus unable to move in on the subject with the light before taking the picture.

It is known that red light generally does not have the same effect on the seagoing creatures, who often do not see or react to red light due to the filtering effect of the water which over 30 feet in depth typically filters out most red and yellow wavelengths. Consequently the fish or other animals do not react to red light. For this reason, one solution previously provided on focus lights has been a red flip-down filter that can be brought down over the front lens or window of the white light.

Red light has the additional advantage that it tends to attract fewer small creatures that are often attracted to white light and tend to swarm around white lights, interfering with the shot. This causes the photographer to turn lights off completely and wait until the swarming creatures, often the size of small flies or gnats, leave the area before turning the lights back on just before taking the shot.

Dive lights are often used by divers for viewing scenes and objects, whether or not in support of underwater photography. To illuminate a large scene a diver will need a flood light, while looking deep into a cave, or signaling a companion, usually requires a spot beam. Until this invention there has been no compact, high-power unitary device that is quickly toggled between flood beam and spot beam.

There is a need for a more efficient, compact, convenient, and high-powered underwater lighting device for conveniently switching between one form of light projection to another, while also preferably allowing for adjustment of light level.

SUMMARY OF THE INVENTION

The invention addresses these needs by providing an LED underwater light, which can be hand-held or mounted on an underwater camera housing, and which in one embodiment is for use in initial focusing with a still underwater camera. As noted above, the device is used to provide sufficient initial white light on a subject to locate a subject and to allow focusing of the camera through its auto focus feature. Incorporated in the disclosed focus light is a red light source to which the focus light can be switched from the initially projected white light. The switch is used to switch off a series of white LEDs while switching on a series of red LEDs. In this way a diver at night can search for subjects using the white light, allowing the camera to auto focus on a subject, then switch to the red light to move in closer, so that sea animal subjects will not see or react to the red light. In a preferred arrangement a single printed circuit board has rows or arrays of white LEDs adjacent to red LEDs. A rechargeable battery pack powers the LEDs, and a selection switch conveniently located on the light housing allows the diver to switch on the white light LEDs, adjust light level, switch to the red light LEDs, and switch the light off. A convenient form of switch is a spring-biased switch positioned on top of the focus light casing, slidable forward or back and returning by spring to a central position. For an effective water seal, the switch preferably comprises a slide member on a switch cover, these components not being under waterproof seal but the light casing or housing being sealed below the switch mechanism. A magnetic coupling between the slide switch member and internal switch pickups in the sealed casing effects the switch selections.

Other features of the focus light include a reflector disc with reflector holes positioned in front of the LEDs, a screw-on front bezel with seals to the main casing, a series of light indicators at the exterior of the housing for showing light status, and a battery charging port at the exterior of the casing.

In another embodiment of the invention a very similarly constructed underwater lighting device enables convenient switching between flood light and spot light projection. Again, a single printed circuit board has two different arrays of LEDs, one with optics for flood light projection and one with optics for spot light projection. The switching is as described above.

The invention thus provides an efficient assembly of an underwater light device that is conveniently used and is quickly switchable between two modes of light. These and other objects, advantages and features of the invention will be apparent from the following description of a preferred embodiment, considered along with the accompanying drawings.

DESCRIPTION OF PREFERRED EMBODIMENTS

Figure 1:
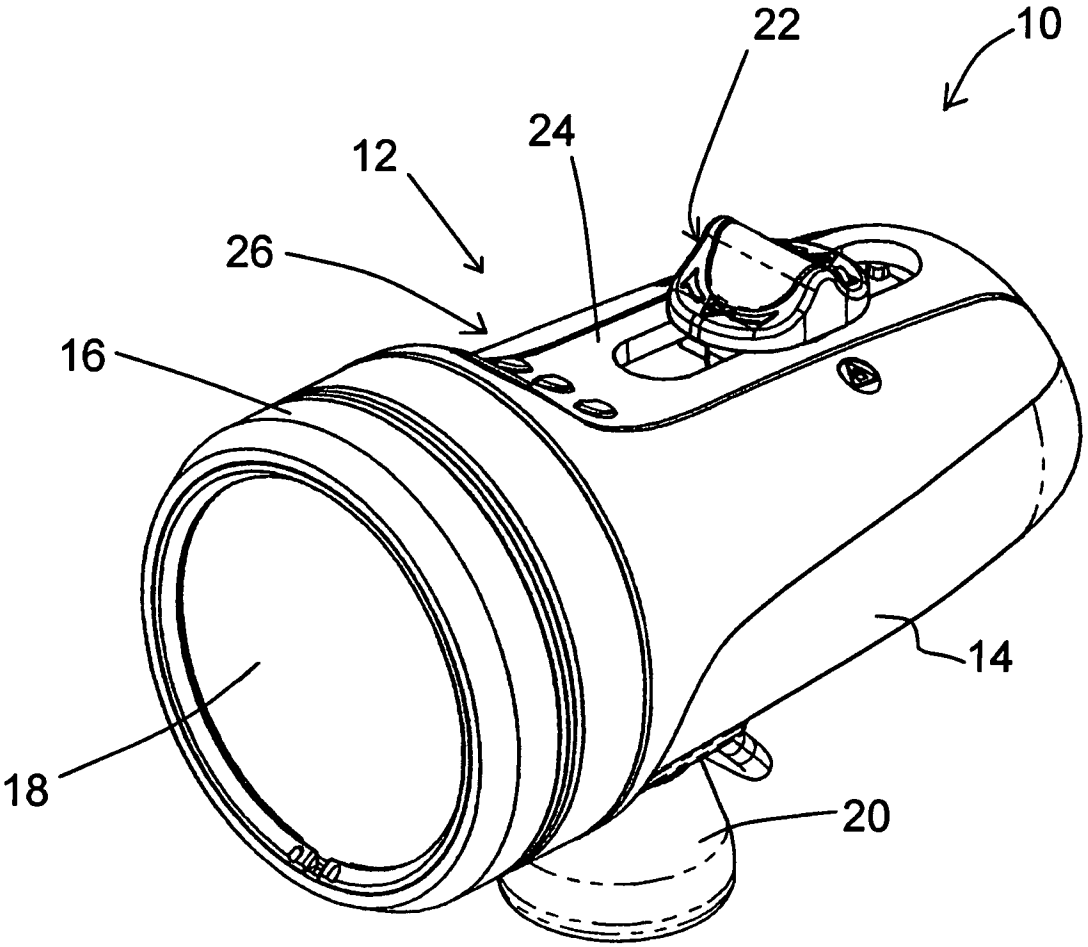
FIG. 1 is a perspective view showing the underwater focus light of the invention.

FIG. 1 shows an underwater photography focusing light 10 of the invention. The focusing light device has a housing 12 including a main body or casing 14 and a front bezel 16 with a window 18 of glass, the casing, bezel and glass being sealed in watertight relationship. To the housing is attached a mounting base 20 having a fitting, not shown, for attachment to an underwater camera housing. At the base of the device is an aluminum plate that accepts a 10-32 or ¼-20 threaded shaft commonly used in the dive industry. The imaging light can be attached in a number of methods. The most common for photography uses a ball joint with a friction clamp that allows the user to position and point the light easily. The other methods employ aluminum strobe arms or flexible plastic "Loc Line" joints that can be added to position the light farther away from the housing.

The housing also includes a slide switch 22 slidable on a slide mounting or switch cover 24. Indicator lights, preferably light pipes that conduct a light from inside the housing, are shown at 26, preferably provided to indicate light status.

Figure 2:
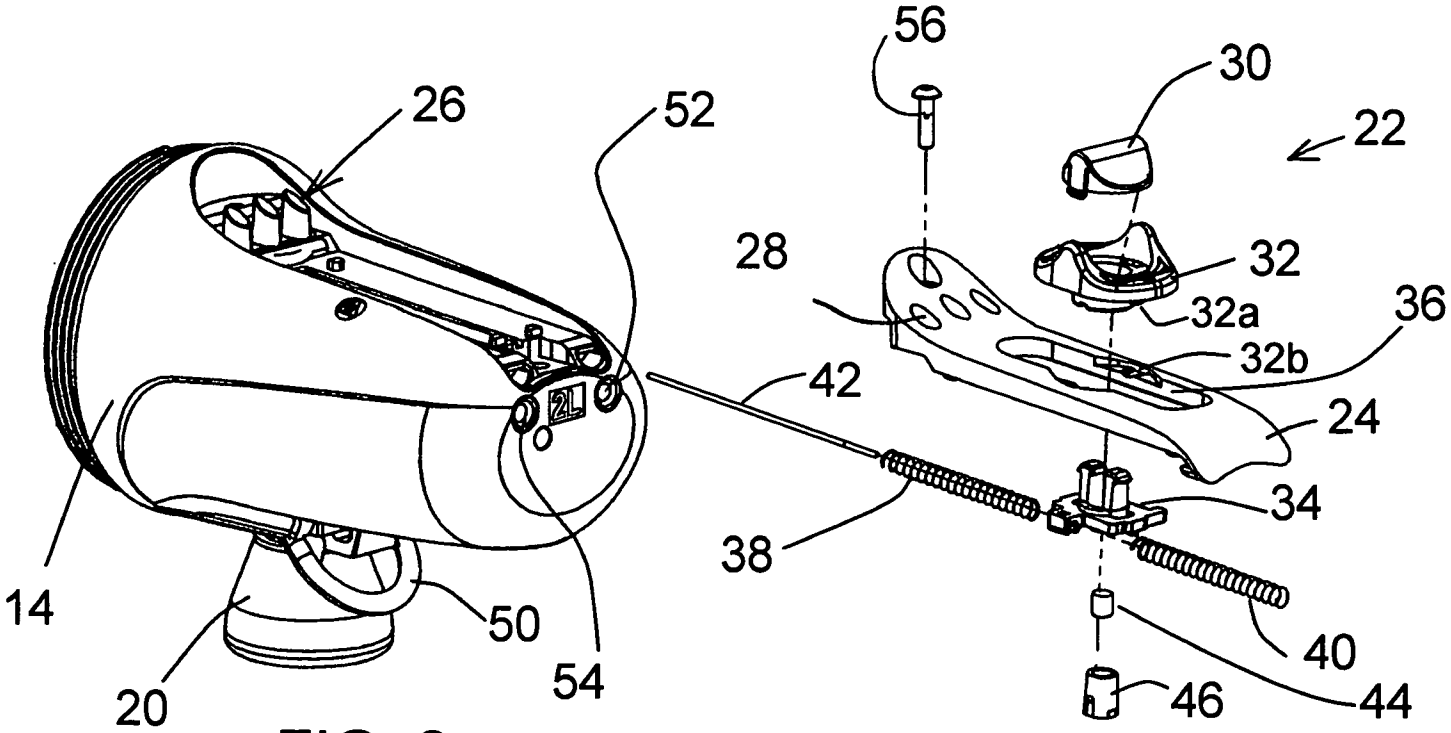
FIG. 2 is an exploded perspective view showing the housing of the light and indicating a switch assembly.

FIG. 2 shows the casing 14 without the front bezel and with the switch assembly removed. The casing or body 14 is water-sealed in the configuration shown, with the switch components being outside the water seal. As shown, the indicator light pipes 26 are positioned to extend up through holes 28 in the slide mounting or switch cover 24. The light pipes direct light from the single driver circuit board (discussed below) up to the proper viewing angle for the diver. Light pipes are typically clear acrylic, molded or extruded, straight or bent, conducting light by internal reflection.

The switch 22 includes a switch cap 30 for finger contact and a switch base 32 that receives the cap, together referred to as a switch or the slide switch 22. A shuttle member 34 of the slide switch 22 connects to the switch base 32 through a slide slot 36 of the switch cover 24, and this shuttle member is biased by compression springs 38 and 40 toward a generally central rest position within the slot 36. The springs 38 and 40 are held in line by a spring shaft 42 and are captured within the assembly when the slide mounting 24 and the other components are in place.

The slide switch 22 preferably has a locking feature to hold it in the rest position when desired, to avoid inadvertent switching on. This is not shown in detail in the drawings, but a small nipple 32*a* can be seen on the bottom side of the switch base 32 in FIG. 2, and a similar nipple can be 180°-opposed. The slide member comprised of the components 32 and 30 can be rotated 90° relative to the switch cover 24, at which point the nipples will engage in detents 32*b* provided in the switch cover. This provides a lock out feature to protect against inadvertent moving of the slide switch and turning the light on when traveling, for example. The switch can be unlocked by again turning the manual slide member (30, 32) 90° in either direction, once again allowing the switch to move forward or back when intentionally pushed.

The switch assembly 22 is not mechanically connected to switch the light color or power. This is effected by a magnetic coupling, to avoid the need for a dynamic water seal. The assembly includes a magnet 44 held within a magnet cup 46 that is secured at the bottom of the switch shuttle 34. Movement of the switch assembly including the magnet 44, by sliding the switch cap 30, is picked up by electronics within the sealed casing 14 as further discussed below.

FIG. 2 also shows a D-ring 50 preferably included adjacent to the mounting base 20, that allows the light to attach to a lanyard for non-photographic applications such as scientific dives. Also, at the rear of the casing are charging ports 52 and 54 for the battery (preferably a lithium-ion battery) contained within the casing for powering the lights. The charger has mating gold plated male plugs that insert into the exposed female charging ports and causing the internal battery to be charged. The two ports provide plus and minus connections. There is a third pin that insures the plug can only be inserted in a single orientation.

As indicated in FIG. 2, when the switch components are assembled in place, a fastener, e.g. a threaded bolt 56, secures the slide mount or switch cover 24 in place on the casing. A clip is preferably included at the rear of the switch cover to retain that end in place without a need for a fastener. Other arrangements can be used.

Figure 3:
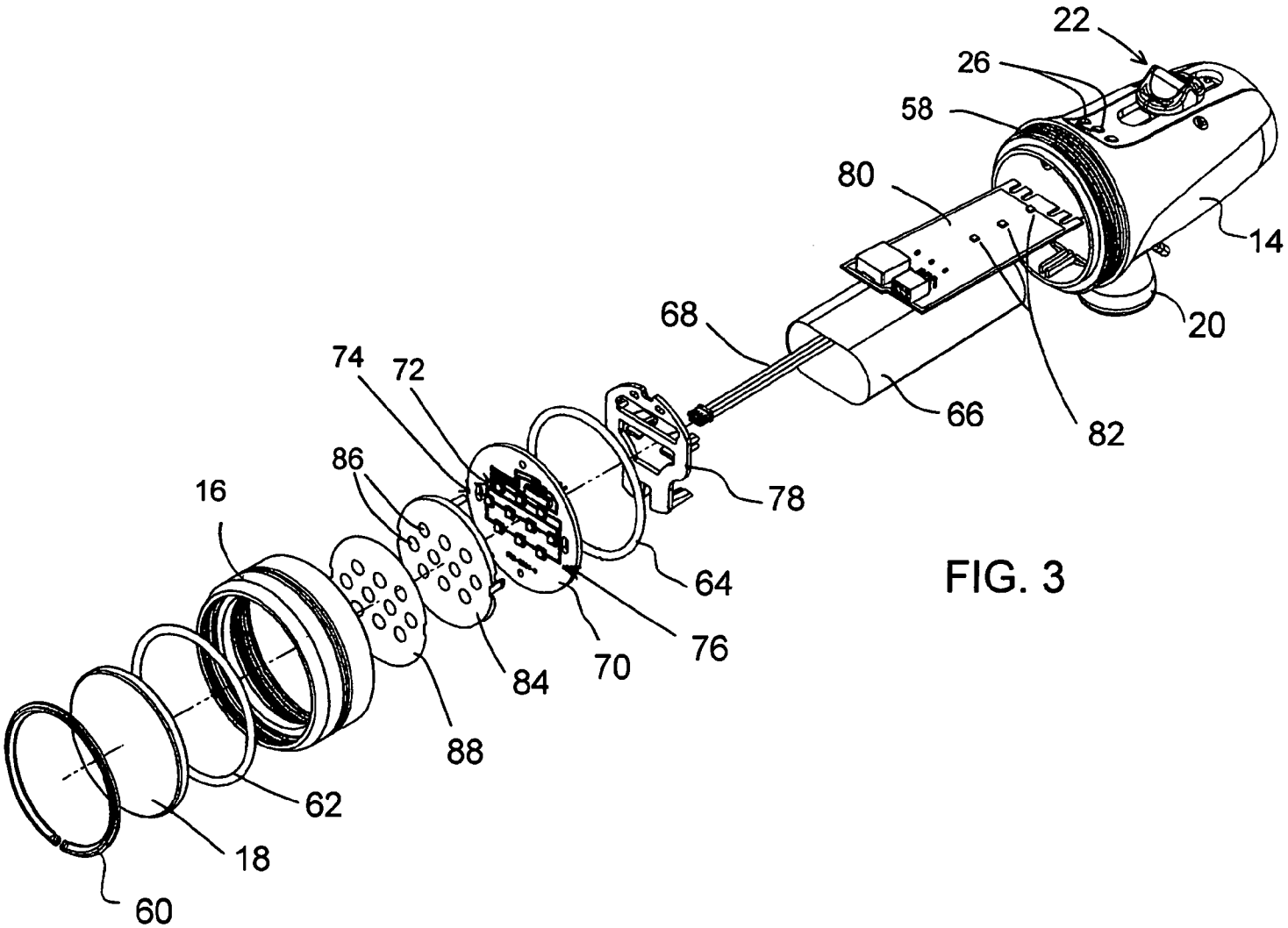
FIG. 3 is an exploded perspective view showing assembly of internal components of the focus light.

The exploded view of FIG. 3 indicates assembly of internal components into the casing 14, and closure of the housing via the bezel 16 and window 18. Threads 58 make the connection. A window retaining ring 60 is shown for holding the window within the bezel, and elastomeric O-ring seals are shown at 62 and 64.

A battery casing is shown at 66 for the rechargeable battery. A cable 68 carries power, after switching, to a printed circuit board or LED board 70 that carries rows of LEDs 72, 74 and 76. The cable 68 plugs into the back of the PCB 70. A PCB retainer is shown at 78.

An LED driver printed circuit board 80 includes switching for the LEDs. The switching is operated by magnetic pickups 82, three of which are seen in the drawing. These are sensitive to the movement of the slide switch 22 forward and back. In a preferred embodiment, sliding the switch forward momentarily initially turns power on and selects, in sequence, low, medium and high white light power settings. Momentarily moving the switch back to a rear position will switch off white light and turn on red light, which preferably has only one level but could be provided with more if desired. Holding the switch to a rear position or to the forward position will switch power off. If desired the red light could be on whenever power is on; the red LEDs draw less power, about 200 lumens, while the white LEDs can have a high setting at about 600 lumens. The red light could be provided with adjustable power level if desired.

The rows of white LEDs in the illustrated assembly are at 72 and 76, top and bottom. The center row 74 is comprised of red LEDs. A reflector disc 84 immediately in front of the LED printed circuit board 70 has individual reflectors 86 positioned in front of each LED, with a desired angle of reflection provided as a conical annulus in each opening. A reflector mask is shown at 88.

Three additional small LEDs, not shown, are on the PC board 70 in position to be picked up by the light pipes 26. Preferably multi-color LEDs, these preferably indicate low, medium and high white light settings by the number of light pipes illuminated, and with different colors also indicate remaining battery charge. For example, green light from the light pipes can indicate above 75% power remaining; amber can signal 50% to 75%; red can warn of 25% to 50%; and flashing red can show a critical condition of under 25% battery remaining. This is very important in underwater night photography.

The illustrated focusing and imaging light assembly is efficient in design, is readily attached to an underwater camera casing and is very conveniently used for use of initial white focusing light, at a selected level, and for instant switching to red light for moving in on a subject. An underwater camera continues to auto focus the subject under red lighting, without startling the living photography subject.

Figure 4:
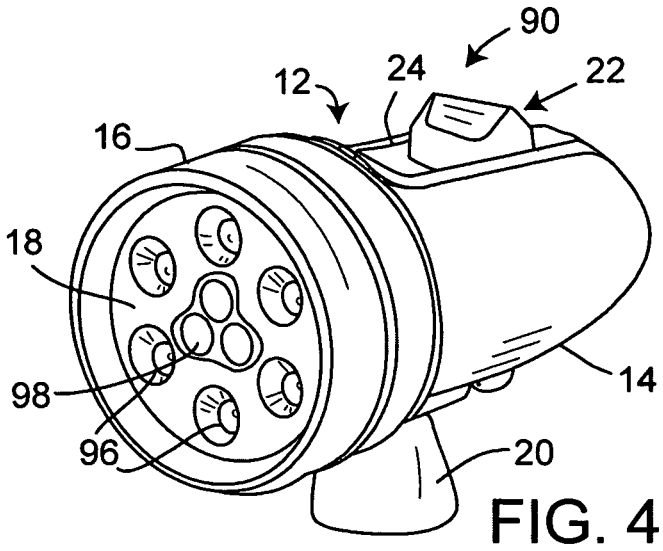
FIG. 4 is a frontal perspective view showing a second embodiment of the invention in which the underwater light device switches between flood light and spot light.
Figure 5:
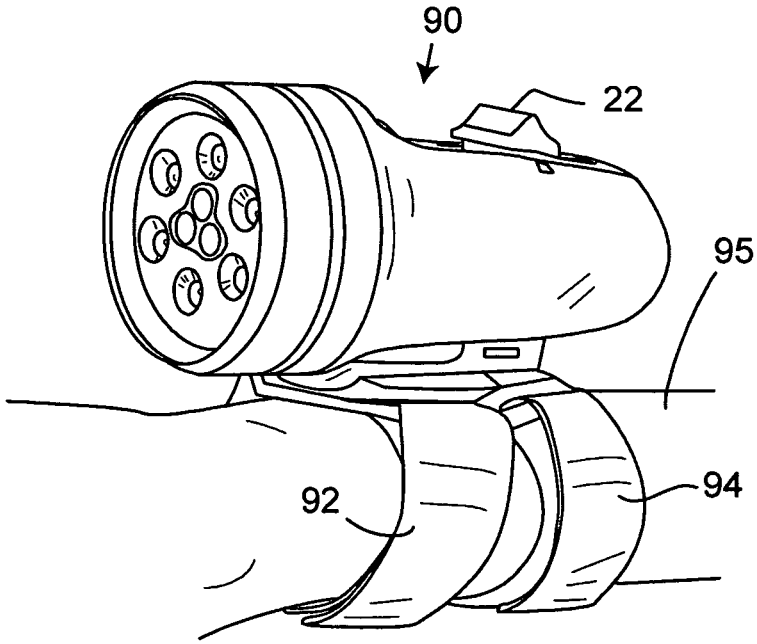
FIG. 5 is a perspective view schematically indicating a wrist strap on the dive light of this embodiment.

FIG. 4 shows in perspective a second embodiment of an underwater light 90 of the invention. As in the above embodiment, this dive light can have a base 20 to enable mounting on another underwater device, or it can have a bracket to provide a wrist mounting. FIG. 5 shows a wrist mounting, with two straps 92 and 94 to extend around the user's wrist indicated at 95. The respective straps can engage around the wrist and palm.

The flood/spot underwater dive light 90 has exterior components similar to those of the above-described device 10: a housing 12 including a main body or casing 14 and a front bezel 16 with a window 18 preferably of glass. The casing, bezel and glass are in sealed watertight relationship. Also similar to the above embodiment, the housing assembly includes a slide switch 22 slidable on a slide mounting or switch cover 24. Indicator lights as in the first embodiment preferably included, as shown at 26 in FIG. 1.

The construction of the casing 14 and the switch assembly is similar to that shown in FIG. 2 and described above. The slide switch 22 preferably also functions in the same way as described above, although switching between different types of LED arrays.

FIG. 4 shows a ring of flood LEDs 96, which can be six in number, in an outer array within the glass window 18. At the center of the ring of flood LEDs is a tight cluster of preferably three spot LEDs 98. The slide switch 22 is used to select between flood light via the LEDs 96 and spot light via the LEDs 98, by momentarily moving the switch back to a rear position. Other control options using the slide switch 22 are the same as above: toggling the switch forward changes the power level, with level status being indicated by the light pipes 26 shown in FIG. 2. Holding the switch to a rear position or to the forward position will be effective to switch off power. Also as discussed above, the switch 22 preferably has a locking feature to hold it in the rest position when desired, to avoid inadvertent switching. The locking feature structure is the same as described above.

Figure 6:
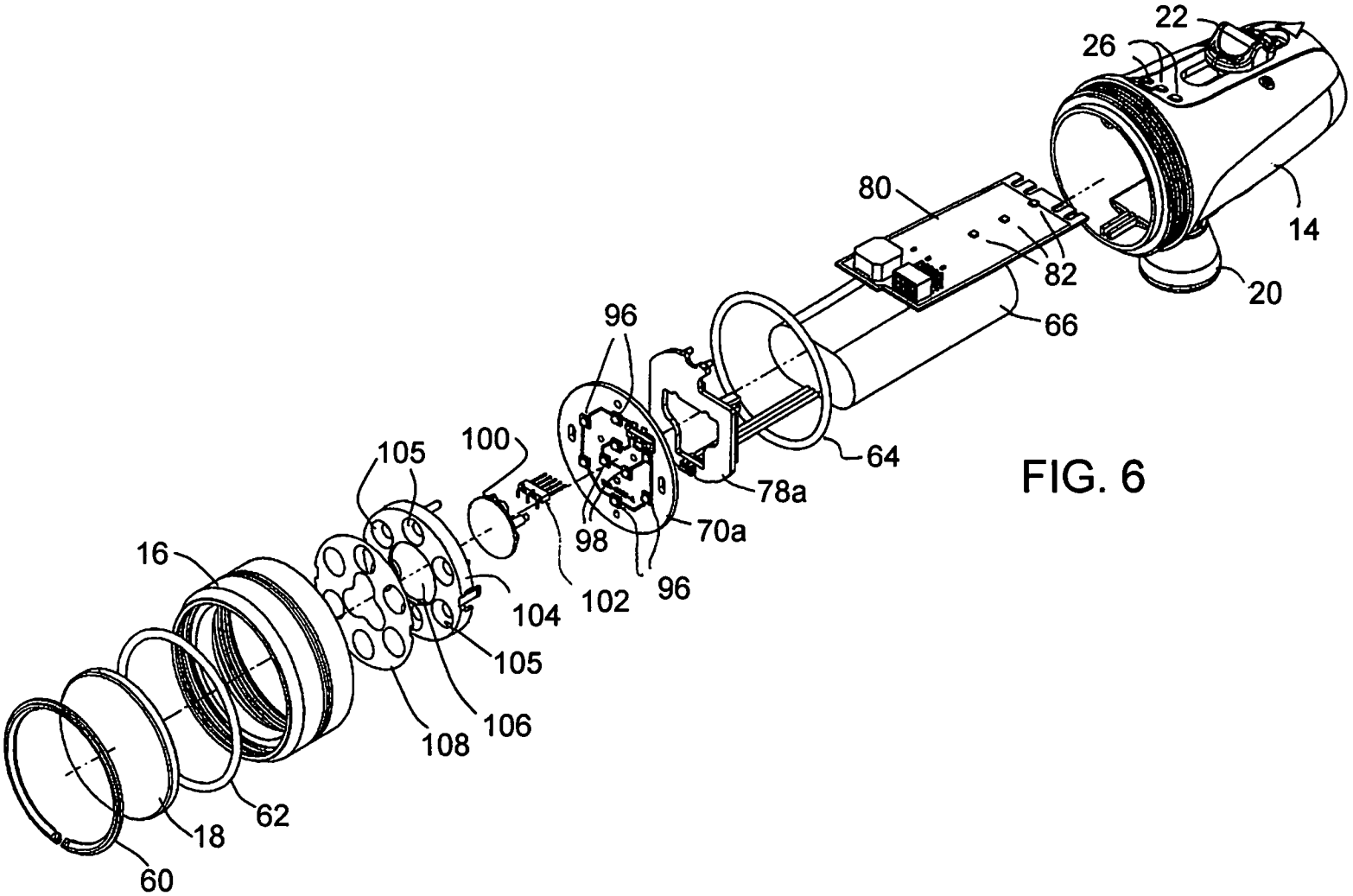
FIG. 6 is an exploded perspective view similar to FIG. 3, but showing the construction and assembly of the light device of the second embodiment.

FIG. 6 is an exploded assembly drawing very similar to that of FIG. 3, but with the flood/spot LEDs and optics rather than the red/white LEDs discussed for the earlier embodiment. In FIG. 6 the same reference numbers are used for components that are the same as those in FIG. 3.

In this form of dive light, the LED printed circuit board or LED board 70*a* is fitted into the assembly and the casing 14 in the same way as above, but the LEDs and optics are somewhat different. As noted above, an outer ring of preferably six flood LEDs 96 are mounted on the LED board 70*a*, connected in series as shown, and a tight cluster of preferably three centrally located LEDs 98 are the spot LEDs, also connected in series but in a separate circuit from the flood LEDs. A PCB retainer is shown at 78*a*, behind the LED board 70*a*.

The focus LEDs 98 project light that is focused by a transparent mounting plate 100 having three TIR (total internal reflection) lenses that focus the LED light to spot focus. The spot angle in a preferred embodiment is between about 8° and about 17°, or slightly wider. A pin connector seen at 102 is soldered to the front of the LED board 70*a*, which is a metal core board with dielectric at front, and the pins extend through to connect with the LED driver printed circuit board 80.

As shown in FIG. 6, a reflector 104 for the flood LEDs 96 has a center opening 106 sufficiently large to accommodate the TIR lens plate 100. The reflector 104 includes essentially conical reflector recesses 105, one for each flood LED. A sticker 108 is secured over the assembled reflector 104 and TIR device 100, for decorative purposes as seen in FIG. 4.

The TIR lens, a solid piece of clear plastic, does an effective job of focusing the beam into a tighter spread in a short space. The flood reflectors 105 are shallow, and the LEDs need to be placed as close to the glass as possible to get the wide beam desired—approximately 60°. A spot beam requires a deeper reflector or a TIR lens to gather the light emitted widely and to redirect it back center, creating a spot beam. Achieving the two types of beams from the same device is difficult—LEDs close to the glass window for flood light and LEDs far back from the window for a spot beam. Although reflectors could be used to create the spot beam, TIRs tend to be smaller for doing the equivalent focusing. Since all the LEDs are mounted on the same PCB to keep costs lower (versus having two different PCBs positioned at different distances from the glass to allow room for a shallow and a deep reflector), the invention makes a compromise with a moderately shallow system design that allows enough depth for a reasonable spot beam (about 8° to 17°) while still allowing the flood to deliver close to 60°.

The flood reflectors are "a-focal". They are designed to spread the beam and mix it to make it clean. Instead of a typical parabolic reflector the flood reflector is simply a cone that scatters the light and thereby encourages a clean mixing of the light with no focal point, producing a nice even flood. Because the flood reflector is somewhat deeper than the depth needed for the TIRs for the spot, the a-focal cones can have a step in them, with a tighter cone close to the LED, stepping wider to essentially put the cone surface farther from the LED so it does not interfere with the escaping light.

In one preferred embodiment, the diving light 10 of the invention emits a flood light beam, at maximum power, of about 1200 lumens. The spot beam is preferably about 500 lumens. The weight of the unit preferably is no more than about 265 grams (0.6 pound). The flood beam angle is about 60°, while the spot angle preferably is in the range of about 8° to 17°. On a full battery charge the unit will produce 1200 lumen flood light for about 70 minutes; 600 lumen flood light for about 140 minutes, and 300 lumen flood light for about 280 minutes. Charge time is about 150 minutes.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A focus light for divers, comprising:

a waterproof housing, a plurality of LEDs mounted in the housing for projection out a front of the housing, including white light LEDs and red light LEDs, driver circuitry in the housing for the white and red LEDs, arranged to drive the white LEDs and red LEDs separately, a reflector positioned in front of the LEDs to direct light from each LED as desired, a window at the front of the housing through which LED light can be projected in a forward direction, a power source, and a switch accessible at exterior of the housing, operatively connected to switch on power from the power source to the LEDs and to selectively power the white light LEDs and the red light LEDs, the switch comprising a slide switch with an exterior manually operated slide member positioned on the exterior of the housing for sliding movement on a switch cover, the slide member being spring-biased toward a rest position, and the housing being water sealed below and independently of the slide member and switch cover, with a magnet connected to the slide member, and the switch including, in an internal sealed space in the housing, magnetic pickups in the circuitry to detect movement of the magnet and to effect power on, power off and selections between red and white light, the slide switch further including a lockout feature on the slide member engageable manually when the slide member is in the rest position, the lockout feature being effective to prevent unintended switching of the focus light.

2. The focus light of claim 1, including in the housing a printed circuit board with LED drivers and the magnetic pickups.

3. The focus light of claim 1, wherein the switch includes selection among multiple white light power levels.

4. The focus light of claim 1, wherein the reflector has a series of conical reflector holes positioned to be directly in front of the LEDS.

5. The focus light of claim 4, further including indicator lights on the exterior of the housing, indicating power level of the white light.

6. The focus light of claim 1, wherein the housing comprises a casing and a front cover comprising a bezel retaining the window, the bezel having screw threads for securing to the casing via threads on the casing.

7. The underwater light of claim 1, wherein the waterproof housing includes a mounting base for securing to an underwater camera housing.

8. The underwater light of claim 1, wherein the rest position is an intermediate position of the slide switch and wherein the slide switch is capable of linear movement in first and second opposed directions from the rest position against the spring-biasing, and wherein the switch includes means for switching between red light and white light when the slide switch is slid momentarily in said first direction to a first position, and for turning off power by sliding and holding the slide switch to either said first or second position.

9. An underwater light for divers, comprising:

a waterproof housing, a plurality of LEDs mounted in the housing for projection out a front of the housing, including a first array of first LEDs and a second array of second LEDs, driver circuitry in the housing for the first LEDs and the second LEDs, arranged to drive the first LEDs and second LEDs separately, optics positioned in front of the first and second LEDs to direct light from the LEDs as desired, a window at the front of the housing through which selected first or second LED light can be projected in a forward direction, a power source, and a switch accessible at exterior of the housing, operatively connected to switch on power from the power source to the LEDs and to selectively power the first LEDs or the second LEDs, to project, as desired, first LED light or second LED light, the switch comprising a slide switch with an exterior manually operated slide member positioned on the exterior of the housing for sliding movement on a switch cover, the slide member being spring-biased toward a rest position, and the housing being water sealed below and independently of the slide member and switch cover, with a magnet connected to the slide member, and the switch including, in an internal sealed space in the housing, magnetic pickups in the circuitry to detect movement of the magnet and to effect power on, power off and selections between said first and second LED light, the slide switch further including a lockout feature on the slide member engageable manually when the slide member is in the rest position, the lockout feature being effective to prevent unintended switching of the underwater light.

10. The underwater light of claim 9, including in the housing a printed circuit board with LED drivers and the magnetic pickups.

11. The underwater light of claim 9, wherein the waterproof housing includes a mounting base for securing to an underwater camera housing.

12. The underwater light of claim 9, wherein the rest position is an intermediate position of the slide switch and wherein the slide switch is capable of linear movement in first and second opposed directions from the rest position against the spring-biasing, and wherein the switch includes means for switching between said first and second LED light when the slide switch is slid momentarily in said first direction to a first position, and for turning off power by sliding and holding the slide switch to either said first or second position.

13. The underwater light of claim 12, wherein the switch further includes power adjustment means for adjusting power of the LED light among low, medium and high settings when the slide switch is slid momentarily in said second direction to said second position.

14. An underwater light for divers, comprising:

a waterproof housing, a plurality of LEDs mounted in the housing for projection out a front of the housing, including white light LEDs and non-white light LEDs, driver circuitry in the housing for the white and non-white LEDs, arranged to drive the white LEDs and non-white LEDs separately, a reflector positioned in front of the LEDs to direct light from each LED as desired, a window at the front of the housing through which LED light can be projected in a forward direction, a power source, and a switch accessible at exterior of the housing, operatively connected to switch on power from the power source to the LEDs and to selectively power the white light LEDs and the non-white light LEDs, the switch comprising a slide switch with an exterior manually operated slide member positioned on the exterior of the housing for sliding movement on a switch cover, the slide member being spring-biased toward a rest position, and the housing being water sealed below and independently of the slide member and switch cover, with a magnet connected to the slide member, and the switch including, in an internal sealed space in the housing, magnetic pickups in the circuitry to detect movement of the magnet and to effect power on, power off and selections between white and non-white light, the slide switch further including a lockout feature on the slide member engageable manually when the slide member is in the rest position, the lockout feature being effective to prevent unintended switching of the underwater light.

* * * * *